US005626175A

United States Patent [19]

Keys

[11] Patent Number: 5,626,175

[45] Date of Patent: May 6, 1997

[54] PLASTIC FILM INDOOR WINDOW INSULATION KIT WITH REINFORCED ACCESS PORTS

[76] Inventor: Donald B. Keys, 983 Pembrook Rd., Cleveland Heights, Ohio 44121

[21] Appl. No.: 415,417

[22] Filed: Apr. 3, 1995

[51] Int. Cl.[6] ..... E06B 9/30

[52] U.S. Cl. ..... 160/168.1; 160/173; 160/178.1; 160/180; 52/405.3

[58] Field of Search ..... 160/89, 107, 173 R, 160/177 R, 178.1 R, 180, 368.1, 237; 52/202, 404.1, 405.3, 405.4, 407.4

[56] References Cited

U.S. PATENT DOCUMENTS

| | | | |
|---|---|---|---|
| 1,398,017 | 11/1921 | Hewitt | 160/89 |
| 1,535,045 | 4/1925 | Scheidecker | 160/180 |
| 1,807,161 | 5/1931 | Loven | 160/89 |
| 1,980,489 | 11/1934 | Leopold | 160/237 |
| 2,708,927 | 5/1955 | Dixon et al. | 160/180 |
| 3,389,737 | 6/1968 | Arnold et al. | 160/107 |
| 4,249,589 | 2/1981 | Loeb | 160/368.1 |
| 4,258,697 | 3/1981 | Flagg | 126/430 |
| 4,274,469 | 6/1981 | Kuyper et al. | 160/107 |
| 4,316,345 | 2/1982 | Rivette et al. | 160/180 X |
| 4,347,887 | 9/1982 | Brown | 160/368.1 |
| 4,454,691 | 6/1984 | Mitchell | 52/202 |
| 4,647,488 | 3/1987 | Schnelby et al. | 160/170 X |
| 4,768,576 | 9/1988 | Anderson | 160/107 |
| 4,932,454 | 6/1990 | Swope | 160/180 X |
| 4,971,130 | 11/1990 | Bentley | 160/368.1 |
| 5,000,242 | 3/1991 | Coddens | 52/202 X |
| 5,203,129 | 4/1993 | Johnson | 52/202 |

*Primary Examiner*—Blair Johnson
*Assistant Examiner*—Bruce A. Lev
*Attorney, Agent, or Firm*—Fay Sharpe Beall Fagan Minnich & McKee

[57] ABSTRACT

An improvement in clear plastic film indoor window insulation kits. The improvement provides a way to open and to close roller window shades or venetian blinds attached to inside window frames after a sheet of clear plastic film has been stretched across the window and secured to the window's casing. The plastic film indoor window insulation kit has reinforced ports which allows roller shade and venetian blind controls to be operated through the reinforced access ports, without removing or damaging the clear plastic film.

19 Claims, 5 Drawing Sheets

PLASTIC FILM INDOOR WINDOW INSULATION KIT WITH REINFORCED ACCESS PORTS

BACKGROUND OF THE INVENTION

In the past, indoor clear plastic film window insulation kits have primarily been a sheet of clear plastic film stretched across the window and secured to the window's casing by double faced adhesive tape or staples. Windows with roller shades or venetian blinds attached to inside window frames and positioned behind the clear plastic film were not accessible and could not be opened or closed without removing the clear plastic film.

The other option has been to apply the clear plastic film to the outside of a window. For elderly people and people living in upper level apartments (with defective and in many cases NO storm windows at all) applying plastic film to the outside of a window, is virtually impossible. In addition to the difficulty of applying plastic film to outside windows there is the problem of exposure to the elements—high winds, sleet and rain which in many cases cause leaks that are not noticed and thereby goes unattended.

Thermal energy lost through windows which are not adequately sealed to prevent drafts and leaks have been and continues to be a major consumption of the natural energy resources of this nation and the planet.

SUMMARY OF THE INVENTION

This invention provides an improvement in indoor plastic film window insulation kits. It is the purpose of this invention to provide a means to open and to close roller shades or venetian blinds which have been attached to the inside frame of a window (after a sheet of clear plastic film has been secured to the window casing) enclosing the shade or blind beneath the clear plastic film.

In the improvement of this invention a reinforced access port is positioned on the plastic film, in line with the venetian blind's control arm which is used to open and close the venetian blind. A second reinforced access port is positioned on the plastic film, in line with the venetian blind's control cord which is used to raise and to lower the blind.

The reinforced access port of the invention is formed of a thin reinforced vinyl patch being 2 inches in diameter. The far side of the vinyl patch is coated with a thin coat of pressure sensitive adhesive. Centered and adhesively bonded to the adhesive side of the two inch vinyl patch, is a smaller vinyl patch which is ½ inch in diameter. The adhesive coating on the two inch vinyl patch is protected by a release liner. The release liner is 2 inches in diameter and is evenly positioned over the adhesive side of the 2 inch vinyl patch thereby covering the smaller ½ inch vinyl patch. The 2 inch vinyl patch and the ½ inch vinyl patch each have two ⅜ inch incision's which are in line and crisscross at 90° in the center of the vinyl patches. The ⅜ inch crisscross cuts in the center of the vinyl patches forms the reinforced access port of the invention.

With a window having a venetian blind attached to inside window frames, the control stick which is used to open and close the venetian blind is first disconnected from the venetian blind. The toggle on the pull cord used to raise and to lower the venetian blind is also removed. After the control stick and the toggle has been disconnected, a sheet of clear plastic film is stretched across the window and adhesively bonded to double faced tape located around the window's casing.

The protective release liner is removed from the adhesive coating on the vinyl reinforced access ports. One vinyl reinforced access port is then positioned on the plastic film with the opening made by the crisscross incisions being in line with the venetian blind's connector for the control stick, which is used to open and to close the venetian blind. After the vinyl access port is positioned on the clear plastic film, the vinyl access port is bonded to the film by pressing the adhesive side of the vinyl access port against the film. A sharp pointed knife is then used to cut an opening in the clear plastic film, by cutting the clear plastic film through the incisions in the reinforced vinyl access port. The bonding of the reinforced vinyl access port to the clear plastic film, prevents the crisscross cuts in the clear plastic film from spreading.

The control stick used for opening and closing the venetian blind is inserted through the reinforced access port and reattached to the venetian blind's opening and closing mechanism. The venetian blind may then be opened and closed with the control stick without removing or damaging the clear plastic film.

The loose material around the crisscross cuts in the reinforced vinyl access ports serves as flaps which close to fit snug around the control stick, thereby minimizing heat loss through the access port.

The second reinforced access port is positioned on the clear plastic film and centered at the point where the pull cord used to raise and lower the venetian blind, exits from the housing which serves as a frame to support the venetian blind. The second reinforced access port is bonded to the clear plastic film in the same manner as the first reinforced access port.

After the second reinforced access port has been bonded to the clear plastic film a small wire hook is then used to retrieve the venetian blind's raising and lowering pull cord through the second reinforced access port.

After the venetian blind's raising and lowering pull cord has been retrieved through the reinforced access port, the pull cord's toggle is then reattached. The venetian blind may then be raised and lowered by pulling the venetian blind's raising and lowering pull cord through the reinforced access port without damaging the clear plastic film or disturbing the adhesive seal around the window casing.

With a window having a roller shade attached to inside window frames, the roller shade's standard short pull-cord is first replaced by an extended pull-cord. The extended pull-cord being long enough for the cord (with the roller shade being in the extreme up position) to extend downwards and through a metal ring which is firmly anchored at the bottom of the window frame.

Two adjustable wedge shaped roller shade positioning guides (which serve to facilitate the downward movement of the roller shade by positioning the roller shade away from the top ledge of the bottom window frame) are positioned on the top ledge of the bottom window frame of a double hung window. The two guides are positioned one guide to the extreme right side and one guide to the extreme left side of the top ledge of the bottom window frame.

After the roller shade positioning guides are in place on the top ledge of the bottom window frame, the extended pull cord attached to the roller shade is threaded through the metal ring which is anchored in a nylon belt. The nylon belt is anchored and held in place between the window sill and the bottom of the closed bottom window frame. The metal ring, anchored to the nylon belt, is centered between the right and left window frame and is positioned forward slightly beyond the point where the ledge at the bottom window casing and bottom window frame perpendicularly intersect. A sheet of clear plastic film is then adhesively secured to double faced tape located around the window's casing.

A reinforced access port is then positioned on the clear plastic film and adhesively bonded to the clear plastic film, in line with the metal ring anchored by the nylon belt between the window sill and the bottom window frame.

The end of the extended roller shade pull cord is retrieved through the hole in the reinforced access port by using a small hook, to hook and to pull the cord through the port. A toggle is then attached to the end of the pull cord, allowing the roller shade to be lowered and raised by pulling and releasing the toggle attached to the roller shade's pull cord through the reinforced access port.

DESCRIPTION OF THE PREFERRED EMBODIMENT

Although the disclosure to hereof is detailed and exact to enable those skilled in the art to practice the invention, the physical embodiments herein disclosed merely exemplify the invention which may be embodied in other specific structures. While the best known embodiment has been described, the details may be changed without departing from the present invention which is defined by the claims.

Figure 1:
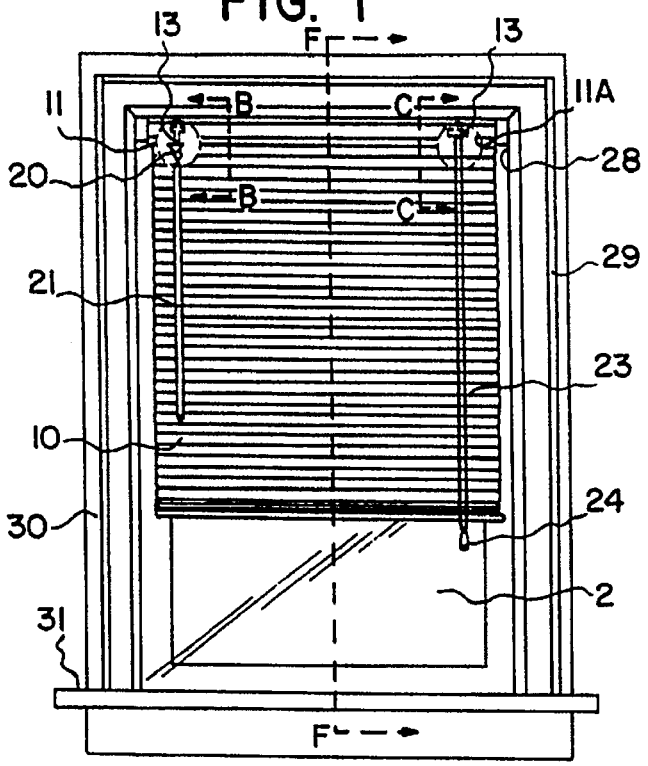
FIG. 1 is a front view of an embodiment of the invention showing a window with a venetian blind attached to the inside window frames.
Figure 12:
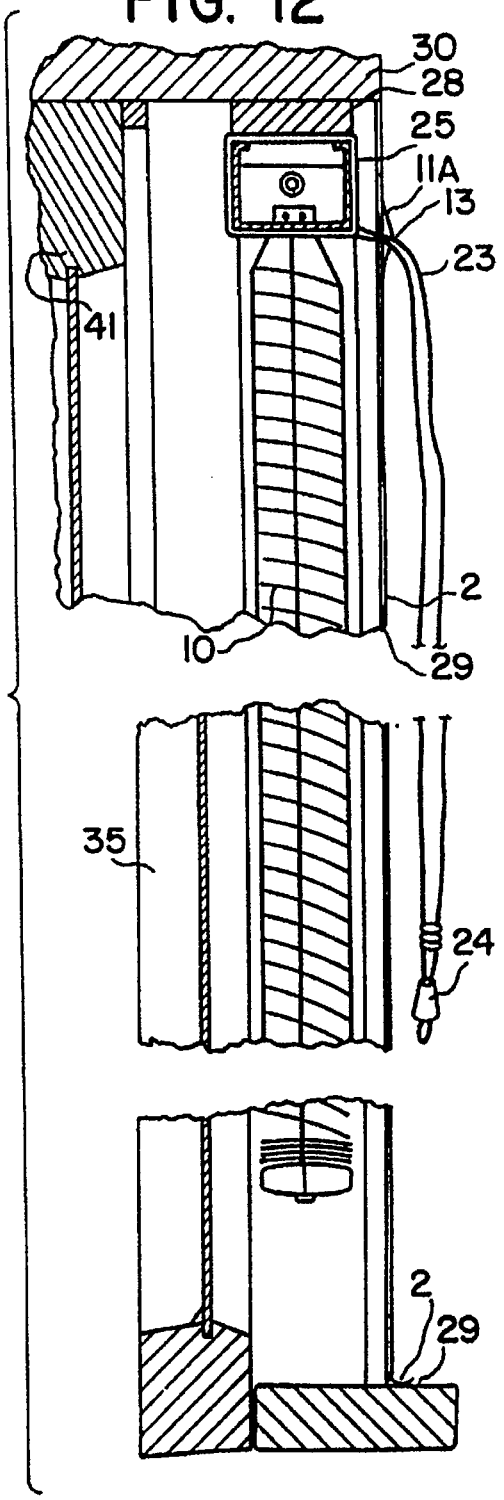
FIG. 12 is a cross sectional view of FIG. 1 taken along the lines of F—F.

Referring to FIGS. 1, and 12, one embodiment of the invention has (after the venetian blind's 10 control stick 21 used to open or to close the venetian blind 10 and the toggle 24 on the pull cord 23 used to raise and to lower the venetian blind 10 have been disconnected) a sheet of clear plastic film 2, stretched and adhesively secured to the front surface of the window casing 30. FIG. 12 shows the clear plastic film 2 is also adhesively secured to the ledge 31, across the bottom of the window casing 30. The clear plastic film 2 is bonded to the window casing 30 and to the ledge 31 by double coated adhesive tape 29 which thereby forms an air tight seal around the window casing 30 and the ledge 31.

Figure 9:
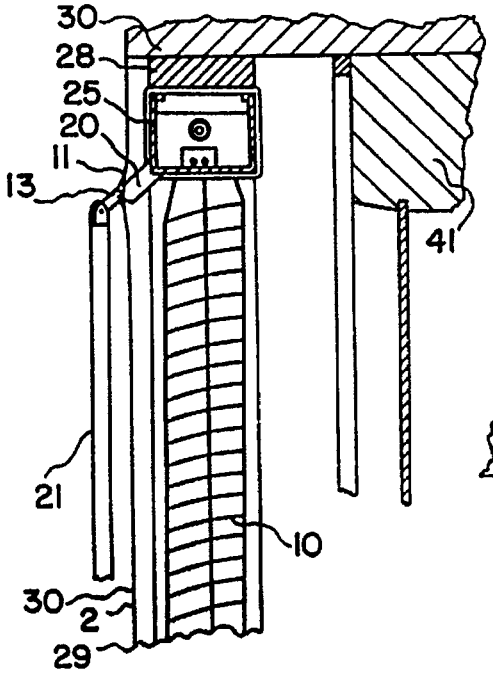
FIG. 9 shows a fragmented cross sectional view of FIG. 1 taken along the lines B—B.

As shown in FIGS. 1, 9 and 12, the venetian blind 10 is attached to inside window frames 28 which thereby positions the blind 10 behind the clear plastic film 2.

Figure 3:
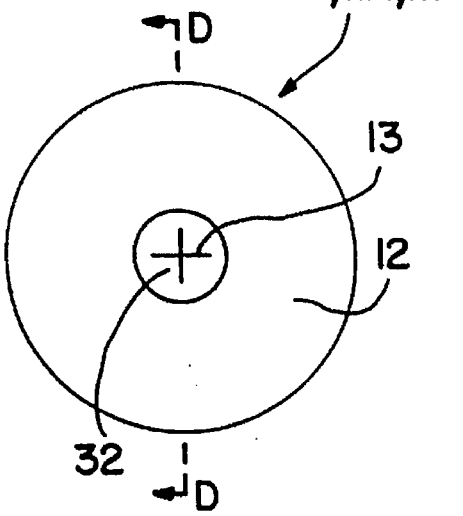
FIG. 3 is a front view showing the invention's reinforced adhesive access ports.
Figure 4:
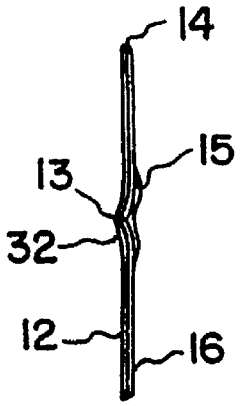
FIG. 4 is a side view showing a cross section of the invention's reinforced adhesive access port along the lines D—D in FIG. 3.

FIGS. 1, 9 and 12 have two reinforced vinyl access ports 11 and 11A adhesively attached to the near side of the clear plastic film 2. FIG. 3 shows a front view and FIG. 4 shows a cross-sectional view of the invention's reinforced access ports 11, 11A and 11B. The reinforced access ports 11, 11A and 11B are shown having a 2 inch in diameter vinyl patch 12, the far side of the 2 inch vinyl patch 12 is covered with a thin coat of pressure sensitive adhesive 14. Centrally affixed to the adhesive side of the two inch vinyl patch 12 is a smaller vinyl patch 15, which is ½ inch in diameter. The adhesive coating 14 on the two inch vinyl patch 12 is protected by a sheet of release liner 16, which is also 2 inches in diameter and is evenly positioned over the adhesive side 14 of the two inch vinyl patch 12, thereby covering the smaller vinyl patch 15. As shown in FIG. 3 and FIG. 4, the 2 inch vinyl patch 12 and the ½ inch vinyl patch 15 each have two ⅜ inch incisions 13. The two incisions 13 crisscross at 90° in the center of the vinyl patches 12 and 15 and are positioned in line to form a ⅜ inch by ⅜ inch reinforced port.

Figure 10:
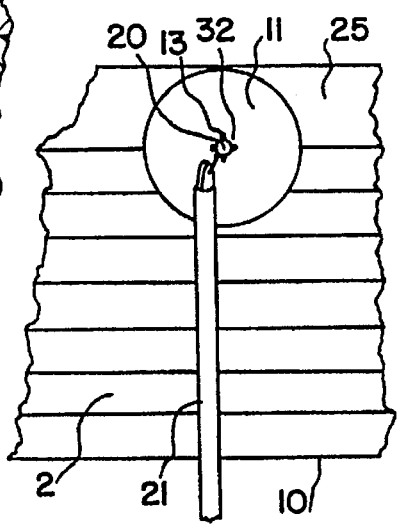
FIG. 10 is an isolated front view of the reinforced access port shown in FIG. 9 with the venetian blind, opening and closing control stick being attached through the access port.

The reinforced access port 11 shown in FIG. 9 and FIG. 10 is positioned and adhesively bonded to the clear plastic film 2, with the crisscross incisions 13, centered over the venetian blind's connector 20 for the control stick 21 which is used to open and to close the venetian blind 10. A sharp pointed knife is then used to cut a crisscross opening in the clear plastic film 2. The opening in the clear plastic film 2 is made by cutting the clear plastic film 2 through the crisscross incisions 13 in the reinforced access port 11. The bonding of the reinforced access port 11 to the clear plastic film 2 prevents the incisions in the plastic film 2 from spreading beyond the reinforced access port 11.

FIG. 9 and FIG. 10 has the control stick 21 used to open and to close the venetian blind 10, reattached through the incisions 13 in the reinforced access port 11, to the connector 20 for the venetian blind's 10 opening and closing mechanism. After the control stick 21 has been reattached to the connector 20 for the venetian blind's 10 opening and closing mechanism, the venetian blind 10 may then be opened or closed without removing or damaging the clear plastic film 2.

FIG. 9 and FIG. 10 has the loose vinyl material 32 resulting from the crisscross incisions 13 in the reinforced access port 11 serving as reinforced flaps 32 which close around the connector 20 for the venetian blind's 10 opening and closing mechanism and thereby minimizing the amount of heat loss through the opening 13 in the reinforced access port 11.

FIG. 9 and FIG. 10 has the ½ inch vinyl patch 15 serving to reinforce the area around the crisscross incisions 13 in the reinforced access port 11. The ½ inch vinyl patch 15 also serves to shield the adhesive coating 14 around the criss-cross opening 13 in the 2 inch vinyl patch 11 and thereby prevents the connector 20 for the venetian blind's 10 operating controls and the venetian blind's pull cord 23 from adhering or bonding to the flaps 32.

Figure 13:
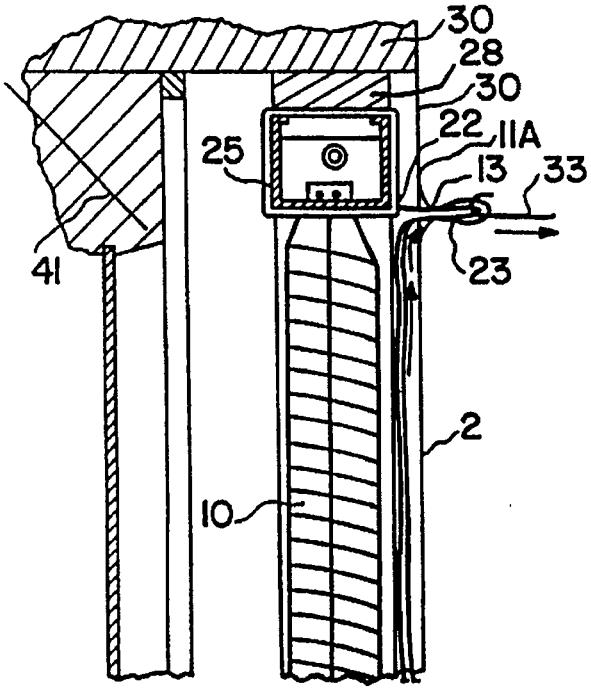
FIG. 13 is a fragmented cross sectional view taken along the lines of C—C showing the venetian blind's raising and lowering pull cord being retrieved through an access port.

FIGS. 1, 12 and 13 has a second reinforced access port 11A positioned and adhesively bonded on the clear plastic film 2. FIGS. 1, 12 and 13 has the access port 11A centered on the clear plastic film at the point 22 where the pull cord 23, used to raise and to lower the venetian blind 10 exits from the housing 25 which frames and supports the venetian blind's 10 operating mechanics.

After the second reinforced access port 11A has been adhesively bonded to the clear plastic film 2, FIG. 13 has a small wire hook 33 retrieving the venetian blind's raising and lowering pull cord 23 through the incisions 13 in the reinforced access port 11A. After the pull cord 23 has been pulled through the opening 13 in the reinforced access port 11A, the pull cord's toggle 24 is reattached to the pull cord 23. The venetian blind may then be raised and lowered by pulling the pull cord 23 through the opening 13 in the reinforced access port 11A, without damaging the clear plastic film 2 or disturbing the adhesive seal 29 around the window casing 30 and the ledge 31.

Figure 2:
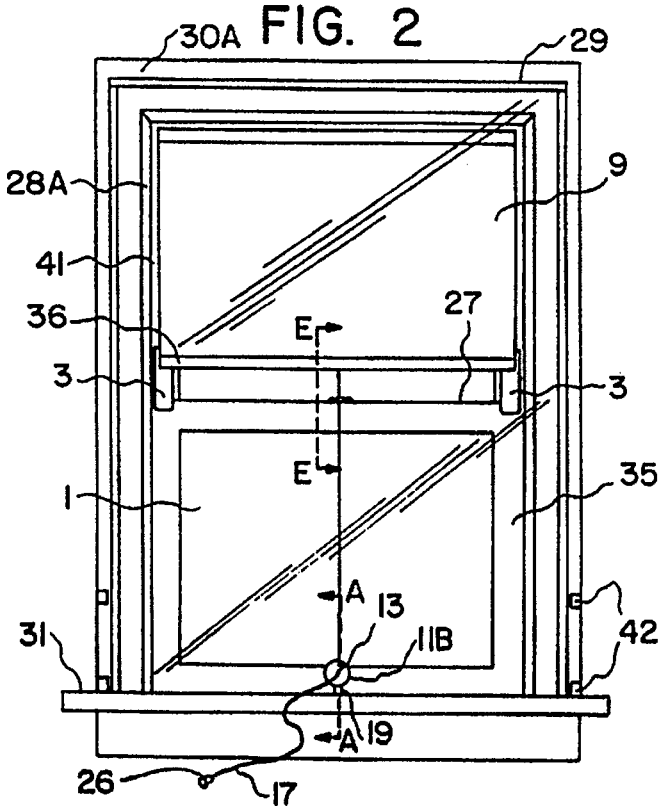
FIG. 2 is a front view of an embodiment of the invention showing a window with a roller shade attached to the inside window frames.
Figure 7:
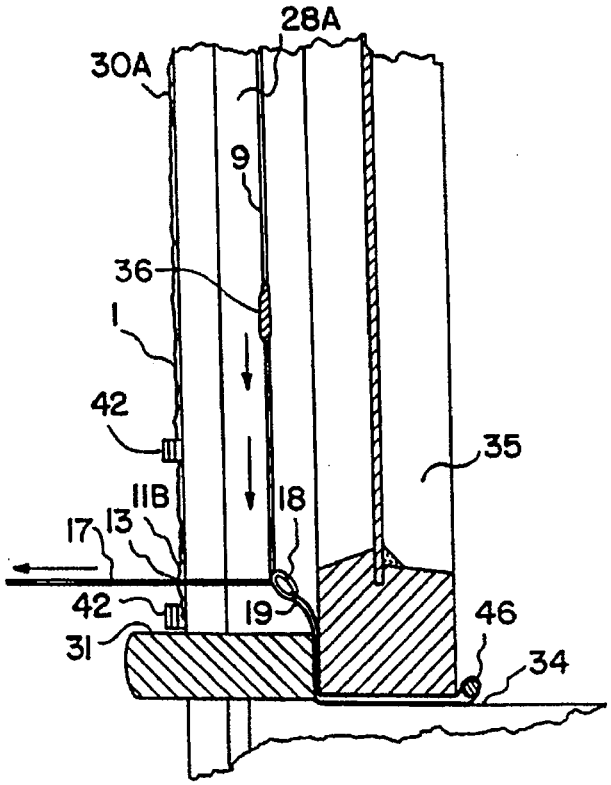
FIG. 7 shows a fragmented cross sectional view of FIG. 2 taken along the line A—A.

FIG. 2 and FIG. 7 has a window with a roller shade 9 attached to inside windows frames 28A. FIG. 2 and FIG. 7 has the roller shade's 9 standard pull cord being replaced with an extended pull cord 17. The extended pull cord 17 being long enough (with the roller shade 9 being in the extreme up position) to extend downwards, through and substantially beyond a ⅛ inch thick by a ½ inch in diameter metal ring 18 which is firmly anchored to a 1½ inch wide by 2½ inch long nylon belt 19.

Figure 11:
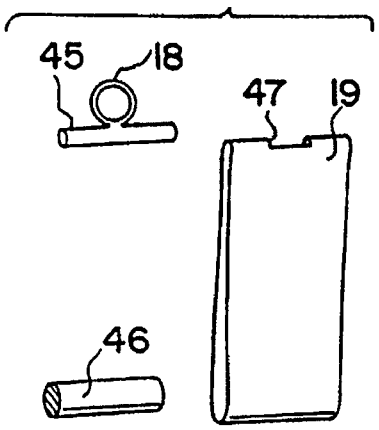
FIG. 11 is isolated views of the unassembled components of FIG. 8.

FIG. 11 shows the ⅛ inch thick by ½ inch in diameter metal ring 18 is welded to a ⅛ inch in diameter by 1½ inch metal bar 45. FIG. 11 has the outer rim of the metal ring 18, centered on the bar 45 and positioned parallel to the bar 45. FIG. 11 also shows the 1½ inch wide by 2½ inch long nylon belt 19 has a ⅛ inch by ½ inch slotted, horizontal hole 47 located in the center of the top loop of the nylon belt 19.

Figure 8:
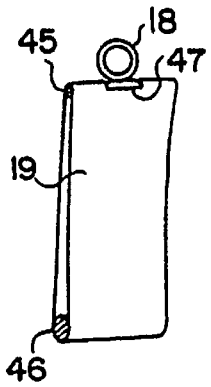
FIG. 8 is a perspective view of the metal ring for the shade's extended pull cord, attached to the nylon belt.

FIG. 8 has the ½ inch metal ring 18 and the 1½ inch metal bar 45 positioned inside the nylon belt 19, with the ½ inch metal ring 18 extending outside the nylon belt 19 through the slotted hole 47. FIG. 8 has the metal bar 45 inside the nylon belt 19 serving as extended arms which anchors the metal ring 18 to the nylon belt 19. FIG. 11 shows an isolated view of a ⅜ inch by 1½ inch wood bar 46. FIG. 8 has the ⅜ inch by 1½ inch wood bar 46 [inside the nylon belt 19] positioned horizontally on the bottom loop of the nylon belt 19.

FIG. 7 has the nylon belt 19 anchored and held in place by being positioned between the window sill 34 and the bottom of the closed bottom window frame 35. FIG. 7 has the ⅜ inch by 1½ inch wood bar 46 inside the bottom loop of the nylon belt 19 and positioned to the outside of the closed bottom window frame 35. The ⅜ inch by 1½ inch wood bar thereby serves as anchor to prevent the nylon belt 19 from being pulled to the inside.

FIG. 7 has the loop of the nylon belt 19, affixed to the metal ring 18, extending slightly beyond the point where the ledge 31 at the bottom of the window casing and the bottom window frame 35 perpendicularly intersect.

FIG. 2 has the nylon strap 19 and the metal ring 18 centered between the right and the left inside window frames 28A.

FIG. 7 has the metal ring 18 anchored in the nylon belt 19 serving as a pulley to redirect the direction of the roller shade pull cord 17 from a vertical up and down direction to a lateral back and forth direction through the reinforced access port 11B.

Figure 5:
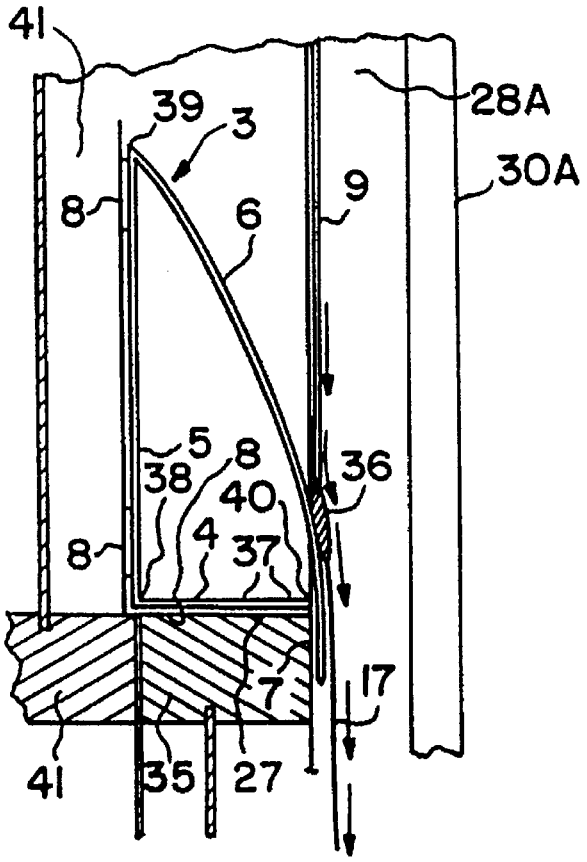
FIG. 5 is a side view of one of the invention's adjustable roller shade positioning guides, positioned on a cross section of the top ledge of the bottom window frame taken along the lines of E—E in FIG. 2.

FIG. 2 and FIG. 5 has two adjustable roller shades positioning guides 3 adhesively attached to and positioned on the top ledge 27 (one guide 3 on the extreme right side and one guide 3 on the extreme left side) of the bottom window frame 35.

FIG. 5 has the roller shade 9 being pulled downwards by the extended pull cord 17 and the shade's stabilizing bar 36, being positioned by the roller shade positioning guides 3 away from the top ledge 27 of the bottom window frame 35. The positioning guides 3 thereby serves to prevent the roller shade 9 from getting twisted or hung up on the top ledge 27 of the bottom window frame 35, which thereby prevents damage to the roller shade 9, or puncture of the clear plastic film 1 after the film 1 has been adhesively secured to the window casing 30A.

Figure 6:
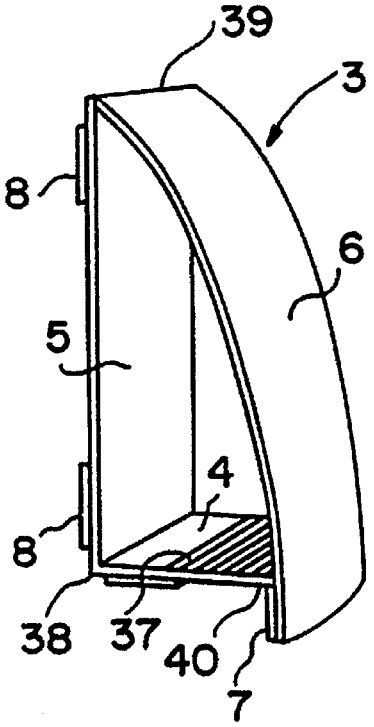
FIG. 6 is a perspective view of an adjustable roller shade positioning guide.

FIG. 5 and FIG. 6 has the adjustable roller shade positioning guides 3 formed of a durable and slightly flexible plastic sheet being 3/64 inch thick by 1½ inch wide by 13½ inches long. The guides 3 with reference to FIG. 5 has a horizontal foot 4, being 2½ inch long. FIG. 5 and FIG. 6 shows that the top surface of the guide's horizontal foot 4 has parallel grooves 37 which are 1/32 inch deep and the grooves 37 run parallel with the heal 38 of the foot 4. The grooves 37 began at 1⅛ inch from the heal 38 of the guide's foot 4 and are spaced at ⅛ inch apart. The grooves 37 serves as a means to adjust the guide's foot 4 to the dimension of the top ledge 27 of the bottom window frame 35. The length of the guide's foot 4 is adjusted by flexing and evenly breaking of excesses material of the guide's 3 foot 4 which extend beyond the top ledge 27 of the bottom window frame 35.

FIG. 5 and FIG. 6 show the roller shade guide 3 having a rear leg 5 extending at a right angle upwards for 5 inches from the heal 38 of the guide's foot 4. FIG. 5 and FIG. 6 have a front leg 6 extending downwards and forward at an angle of 20° for 6 inches from the apex 39 of the guide's rear leg 5. FIG. 5 has the roller shade guide's front leg 6 arcing downwards on a 12 inch radius. FIG. 5 has the roller shade guide's front leg 6 extending downwards ¾ of an inch below the toe 40 of the roller shade guide's 3 foot 4.

FIG. 5 shows the ¾ inch portion of the far side of the roller shade guide's 3 front leg 6 that extend below the toe 40 of the guide's foot 4, has a double coated adhesive tab 7. The adhesive tab serve to adhesively attach the roller shade guide's 3 front leg 6 to the bottom window frame 35. FIG. 5 also has double coated adhesive tab 7 and 8 attached to the bottom of the guide's foot 4 and attached to the far side of the guide's rear leg 5. FIG. 5 has the double coated adhesive tabs 7 and 8 adhesively attaching the roller shade guide 3 to the top 41 and to the bottom 35 window frames.

The clear plastic film 1 shown in FIG. 2 and FIG. 7 is positioned and adhesively bonded to the window casing 30A after the roller shade guides 3, the roller shade extended pull cord 17 and the metal ring 18 has been positioned and secured in place according to FIGS. 2, 5, and 7.

After the clear plastic film 1 as shown in FIG. 2 and FIG. 7 has been stretched across the window and has been adhesively bonded to the window casing 30A and to the ledge 31, a reinforced access port 11B for the roller shade extended pull cord 17 is then adhesively attached to the clear plastic film. FIG. 2 and FIG. 7 has the reinforced access port 11B positioned in line with the metal ring 18, anchored to the bottom window frame 35.

The roller shade extended pull cord 17 is retrieved (as in FIG. 13) through the opening 13 in the reinforced access port 11B by using a small hook 33, to pull the cord 17 through the access port 11B. A toggle 26 is then attached to the end of the pull cord 17 allowing the shade 9 to be lowered or raised (without removing the clear plastic film 1) by pulling and releasing the toggle 26 attached to the roller shade's extended pull cord 17.

The roller shade 9 should not be lowered to leave less than six inches between the bottom of the roller shade stabilizer bar 36 and the metal ring 18.

Allowing six inches between the bottom of the roller shade's stabilizer bar 36 and the metal ring 18, provide ample room for the downward movement necessary to release and to raise a roller shade locked in the down position.

Figure 14:
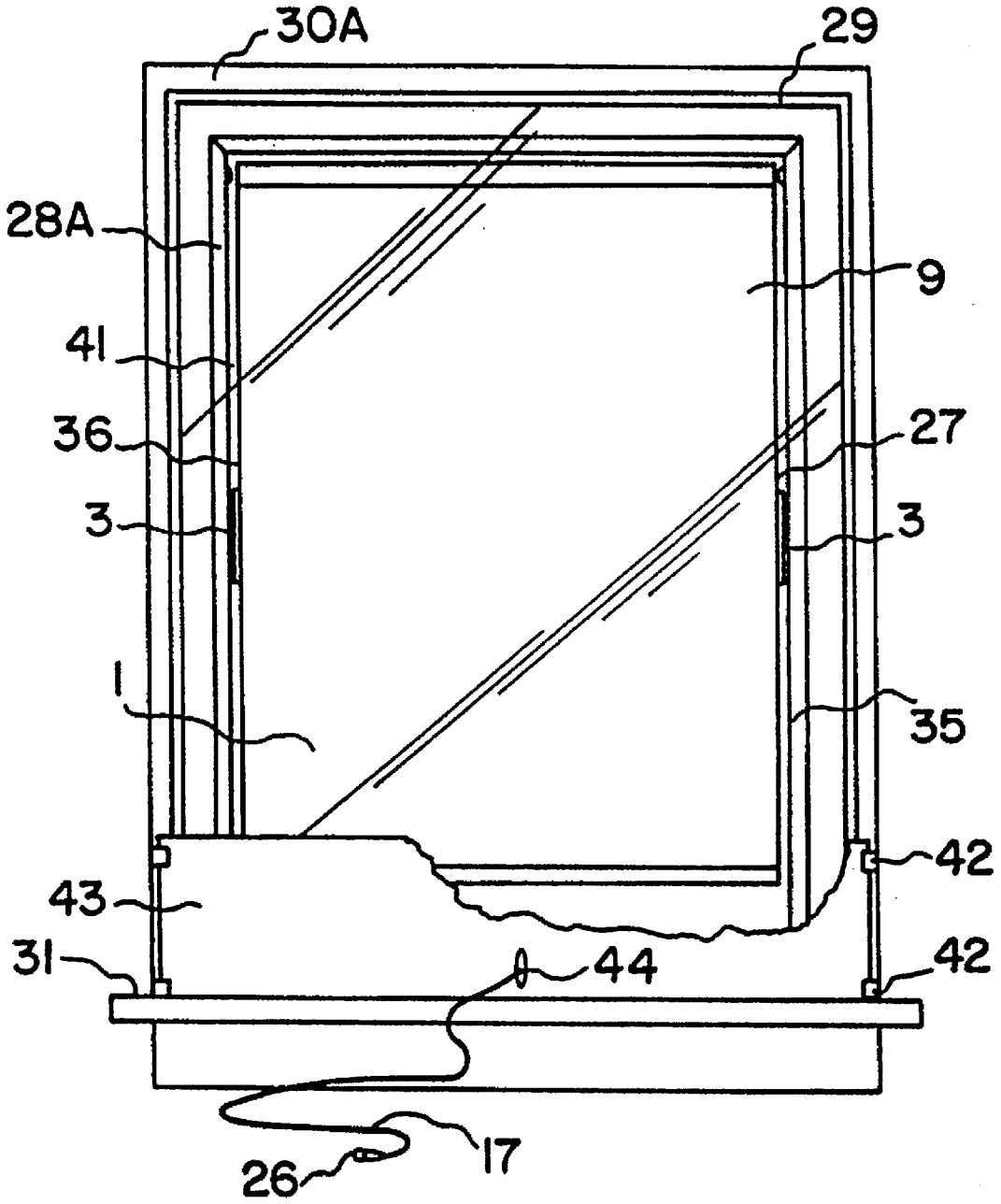
FIG. 14 is a front view of an embodiment of the invention showing a window with a roller shade in the down position and a fragmented view of the removable shield positioned in slots on the window casing.

According to FIG. 7 and FIG. 14 when the roller shade 9 is in the down position, the six inches of the window left exposed, is covered by a removable cardboard shield 43. The cardboard shield 43 is 8 inches high, the width of the cardboard shield 43 is adjusted according to the width of the window casing and is fitted in to slotted brackets 42 position on the window casing 30A.

FIG. 14 shows the cardboard shield 43 has a ½ inch by 3 inch vertically slotted hole 44 centered over the access port 11B. The slotted hole 44 serves to allow the roller shade 9 to be raised or lowered without moving the cardboard shield 43.

What is claimed is:

1. A method of insulating a window of a window installation on an interior of a building, the window installation carrying an adjustable privacy device having an operator control mechanism, the method of insulating comprising the steps of:

applying, in a substantially air tight configuration, a sheet of stretchable insulation, material to the window insulation, whereby the adjustable privacy device having the operator control mechanism is isolated from a user on the interior of the building;

bonding an access port material to a surface of the sheet of stretchable insulation material;

providing an incision through both the access port material and the sheet of stretchable insulation material at substantially identical locations forming an access port; and passing the operator control mechanism through the formed access port.

2. The method of insulating according to claim 1 wherein the step of bonding further includes applying an adhesive to a surface of the access port material and bonding the entire adhesive side of the access port material to the sheet of stretchable insulation material.

3. The method of insulating according to claim 2 wherein the step of providing an incision further includes providing the incision in the access port material prior to the bonding step.

4. The method of insulating according to claim 1 wherein the adjustable privacy device is one of a roller shade and blinds.

5. The method of insulating according to claim 2 wherein the step of passing the operator control mechanism through the passage includes, pushing a hook element through the access port towards the operator control mechanism;

hooking a portion of the operator control mechanism with the hooking device; and, withdrawing the hooking device and a portion of the operator control mechanism back through the access port.

6. The method of insulating according to claim 1 wherein the step of bonding further includes locating the access port material on the sheet of stretchable insulation material in an area substantially horizontal to the portion of the operator control mechanism.

7. In a window insulation kit used to insulate a window located on the interior of a building, where a sheet of stretchable insulation material of the window insulation kit is adaptable to a window installation holding the window and an adjustable privacy device having an operator control mechanism, such that when the sheet of stretchable insulation material is attached to the window installation, the adjustable privacy device having the operator control mechanism is isolated from a user on the interior of the building, the improvement comprising:

an access port material constructed of a reinforced material having a tear strength greater than the sheet of stretchable insulation material, also being provided with incisions, and having an adhesive side which is to be bonded entirely to the sheet of stretchable insulation material whereby an access port is formable through said insulation material and said access port material by cutting said insulation material through said incisions.

8. The window insulation kit according to claim 7 wherein the improvement further comprises, an incision which extends through the reinforced material, such that when the access port material is bonded to the sheet of stretchable insulation material, the incision is a pattern for an incision in the stretchable insulation material.

9. An insulation kit for insulating a window on the interior of a building held in a moveable window installation which allows the window to be moved between an open and a closed position, the movable window installation carrying an adjustable privacy device which can be moved from an open position to a closed position through the use of an operator control mechanism, the insulation kit comprising:

an anchoring device having first and second ends, the first end held between two edges of the window installation when the window is in the closed position, the second end engaged with the operator control mechanism of the adjustable privacy device;

an insulation adhesive;

a sheet of stretchable insulation material sized to cover the window installation, the insulation adhesive material and the sheet of stretchable insulation material used together to adhere the sheet of stretchable insulation material to a surface of the window installation, whereby the window and the adjustable privacy device having the operator control mechanism are isolated from a user located on the interior of the building;

an access port material adhesive;

an access port material bonded to a surface of the sheet of stretchable insulation material with the access port material adhesive; and an incision provided in the access port material whereby an access port is formable through said insulation material and said access port material by cutting said insulation material through said incisions, to thereby define an access port from the interior of the building to the window.

10. The insulation kit according to claim 9 further including positioning guides attachable to the window installation prior to the sheet of stretchable insulation material being adhered, wherein positioning guides assist in movement of the adjustable privacy device.

11. The insulation kit according to claim 9 wherein the operator control mechanism engaged with the second end of the anchoring device is passed through the access port, whereby operation of the adjustable privacy device is controlled by an operator.

12. The insulation kit according to claim 9 further including a privacy screen positioned at substantially a bottom section of the window installation, whereby when the adjustable privacy device is not fully closed the privacy screen acts to block light from passing through the portion of the window not covered by the adjustable privacy device.

13. The insulation kit according to claim 9 further including an operator control mechanism extension, having a first and second end, the first end connected to the operator control mechanism such that at least one of the operator control mechanism and operator control mechanism extension is engaged with the second end of the anchoring device.

14. The insulation kit according to claim 9 wherein the adjustable privacy device is a roller shade.

15. The insulation kit according to claim 9 wherein:

the access port material is a piece of reinforced plastic material smaller than the sheet of stretchable insulation material, having a thickness and tear strength greater than the sheet of stretchable insulation material, one side of which includes an adhesive, the entire adhesive side being bonded to the sheet of stretchable insulation material, and the sheet of stretchable insulation material is a sheet of thin, clear plastic stretched by a user during installation.

16. A window insulation kit for insulating a window in a window installation having an adjustable privacy device, the window insulation kit comprising:

a plastic stretchable film attachable to cover one side of the window installation, whereby the adjustable privacy device is located between the window and the plastic stretchable film;

an access port material sized smaller than the plastic stretchable film, having a thickness and tear strength greater than the plastic stretchable film, with an adhesive side adapted to be adhered entirely to a surface of the plastic stretchable film; and the access port material further including an incision whereby said stretchable film may be cut through said incision, thereby defining an access port through the plastic stretchable film and the access port material.

17. The window installation kit according to claim 16 wherein the access port material includes a first patch having attached to an inside surface of the first patch a second reinforcing patch, the second reinforcing patch having a diameter less than that of the first patch, wherein the access port material acts to prevent an incision of the plastic stretchable film from spreading past the access port.

18. The window installation kit according to claim 17 wherein the access port material and the plastic stretchable film each include a plurality of incisions defining reinforced flaps.

19. A method of forming an access port comprising the steps of:

applying, in a substantially air tight configuration a stretchable insulation material to a window installation on an interior of a building, whereby a window and an adjustable privacy device of the window installation are isolated from a user on the interior of the building;

bonding an adhesive side of an access port material to a surface of the stretchable insulation material such that the adhesive side is completely bonded to the surface of the stretchable insulation material; and cutting through the stretchable insulation material at locations corresponding to predefined incisions of the access port material, such that the incisions act as patterns for the cutting of the stretchable insulation material.

* * * * *